US009794680B2

(12) United States Patent
Oclee-Brown

(10) Patent No.: US 9,794,680 B2
(45) Date of Patent: Oct. 17, 2017

(54) LOUDSPEAKER BASS REFLEX SYSTEM

(71) Applicant: GP Acoustics (UK) Limited, Maidstone (GB)

(72) Inventor: Jack Oclee-Brown, Paddock Wood (GB)

(73) Assignee: GP ACOUSTICS (UK) LIMITED, Maidstone (GB)

( * ) Notice: Subject to any disclaimer, the term of this patent is extended or adjusted under 35 U.S.C. 154(b) by 78 days.

(21) Appl. No.: 14/631,219

(22) Filed: Feb. 25, 2015

(65) Prior Publication Data

US 2016/0249131 A1 Aug. 25, 2016

(51) Int. Cl.
*H04R 1/28* (2006.01)
*G10D 13/02* (2006.01)

(52) U.S. Cl.
CPC ..... *H04R 1/2826* (2013.01); *H04R 1/2819* (2013.01); *H04R 1/2888* (2013.01); *G10D 13/021* (2013.01)

(58) Field of Classification Search
CPC ... H04R 1/2815–1/2826; H04R 1/2884; H04R 1/2888; H04R 1/347; H04R 2460/11; G10D 13/021
USPC ..... 381/349; 181/156
See application file for complete search history.

(56) References Cited

U.S. PATENT DOCUMENTS 4,997,057 A * 3/1991 Furukawa ..... H04R 3/04 181/156
5,109,422 A * 4/1992 Furukawa ..... H04R 1/023 181/160
2013/0333975 A1* 12/2013 Dodd ..... H04R 1/021 181/155
2016/0029137 A1* 1/2016 Price ..... H04R 31/006 29/594
2016/0057531 A1* 2/2016 Lang ..... H04R 1/323 181/199

FOREIGN PATENT DOCUMENTS

GB 2352924 A 2/2001
GB 2488758 A 9/2012

* cited by examiner

*Primary Examiner* — Joshua Kaufman
(74) *Attorney, Agent, or Firm* — Westman, Champlin & Koehler, P.A.; Z. Peter Sawicki; Amanda M. Prose

(57) ABSTRACT

An acoustic insert for lining a loudspeaker reflex port, the insert comprising an elongate hollow tube formed of a flexible material, having an outer wall sized and configured to seat within the port and an inner wall extending in the elongate direction, the inner wall having a circumference which varies along the length of the insert, When inserted in a port, the insert alters the port resonance so as to vary the acoustic perfoi mance of the loudspeaker.

17 Claims, 2 Drawing Sheets

LOUDSPEAKER BASS REFLEX SYSTEM

FIELD OF THE INVENTION

This invention relates to reflex-type loudspeakers, and to liners or inserts for the vented port(s) of such loudspeakers.

BACKGROUND ART

A significant proportion of loudspeakers which are currently commercially available are of the type commonly known as bass reflex loudspeakers. A bass reflex system (also known as a ported, vented box or reflex port) is a type of loudspeaker enclosure that uses the sound from the rear side of the diaphragm to increase the efficiency of the system at low frequencies as compared to a typical closed box loudspeaker or an infinite baffle mounting. Referring to FIG. 1, a bass reflex loudspeaker 1 typically has one or more openings 3 in the loudspeaker enclosure 5 (called reflex ports or vents), each of which usually consists of a rigid pipe, duct or tube 7 (typically circular or rectangular in cross-section) mounted in the front or rear face of the loudspeaker enclosure 5, leading from the air volume 9 behind the driver 11 to the external air. The air 13 in this opening 3 behaves as an acoustic mass whereas the air 9 contained within the enclosure 5 behaves as an acoustic compliance; together these form an acoustic resonator known as a Helmholtz resonator. The frequency at which this acoustic resonance occurs is determined by the length and cross sectional area of air in the opening 3, the volume of air 9 within the enclosure 5, and the speed of sound. Acoustic radiation from the rear of the loudspeaker 1 passes through this acoustic resonator, the acoustic resonator providing in a band-pass response. At the frequency of this acoustic resonance the high pressure in the enclosure 5 reduces the cone motion and acoustic radiation from the front of the loudspeaker diaphragm 15. The combined output from the opening 3 and front of the diaphragm 15 is in the form of a $4^{th}$ order high-pass filter. With suitable choice of driver parameters, enclosure volume and port dimensions a desired response can be achieved. For example a maximally flat $4^{th}$ order butterworth high-pass response is the most obvious choice but, depending on the design constraints, there are numerous other choices.

Reflex systems are widely used since they provide a better combination of efficiency and low frequency extension compared to closed box systems. They also have the benefit of reducing the diaphragm excursion at frequencies around the enclosure tuning frequency where the duct provides the main acoustic output.

In use, the low frequency response of a loudspeaker is strongly dependant on room dimensions, construction materials and the relative positions of listener and loudspeaker. Furthermore, what is an acoustically desirable performance is often a subjective choice, with different listeners preferring enhancement or attenuation of different sound frequencies; however, any single size and configuration of reflex port will have a predetermined and largely fixed effect on the overall acoustic performance of a loudspeaker. One practical method of adjusting the low frequency response of a loudspeaker system is to vary the Helmholtz resonance by altering the properties of the port.

For example, to vary the acoustic performance of a reflex-type loudspeaker, cylindrical plugs (bungs) of foamed polyurethane or felt have been inserted into the opening of the reflex port, and these adjust the resonance in the port by partially blocking it; such an approach is rather crude, such "bungs" introduce turbulence and resistive losses with only a minor change in tuning frequency. The resistive losses introduced by air flowing through the porous bung reduce the bass output of the port with no improvement to low frequency extension. The small decrease in tuning frequency does produce a small improvement in low frequency extension. The turbulence occurs where high air velocity gradients occur in the air flow due to small port area, abrupt changes in port area or discontinuities such as those introduced by the bung. The effect of turbulence is to introduce spurious noise and distortion, and also results in a loss of low frequency energy; consequently turbulence may limit undistorted bass output.

A better approach to adjusting the Helmholtz frequency is to provide the user with some means to adjust the port length and/or area. To avoid turbulence the ports should preferably be flared at both ends avoiding discontinuities of the wall surface along the length of the port.

For example interchangeable ports of different dimensions have been suggested in GB2352924. In such arrangements, a range of ducts, each of different length and/or cross-sectional area, is provided, so that a listener can change the acoustic performance simply by removing and replacing one duct with another of different dimensions. Such arrangements necessitate the storage of a number of alternative ducts which, because reflex ports are usually substantially rigid, takes up an undesirable amount of space. In addition, such replaceable ports need to be firmly fixed in position relative to the loudspeaker enclosure, so a user needs to have tools available to be able to undo a duct for removal and to secure a duct in place. Accordingly such systems are not attractive to users.

Another performance limitation of ports is the response peak due to longitudinal acoustic resonance occurring within the duct. This resonance is highly undesirable since it can cause audible colouration. A method of reducing such resonances is described in GB2488758. Providing the user with interchangeable ports constructed in this way would be highly beneficial, but extremely costly.

SUMMARY OF THE INVENTION

The present invention provides an acoustic insert for lining an outer tube fitted to a loudspeaker enclosure to form a loudspeaker reflex port, the insert comprising an elongate hollow tube formed of a flexible material, having an outer wall, sized and configured to seat within the outer tube, and an inner wall extending in the elongate direction, the inner wall having a circumference (in the plane transverse to the elongate direction) which varies along the length of the insert.

Such inserts are inexpensive to manufacture, easy to use and can be configured to allow a large range of tuning frequency adjustment since both area and length may readily be varied. For example, one form of tuning will give a flat response with more upper bass (such as is suitable for rooms with excessive low frequency absorption) whereas a different (lower) tuning will give a sloping bass response with more very low bass and less upper bass. Because the tubes are easily insertable and removable (partly as a result of their being made of flexible material), it is a simple matter to remove an insert of one size/configuration/material from the outer tube and replace it with a different one, thus changing the acoustic effect provided by the reflex port, enabling a user easily to change the frequency response of the loudspeaker as desired. Accordingly, the present invention has the potential for loudspeakers to be made with acoustic performance which can be varied so as to be equally as acceptable in the home as in applications requiring high accuracy and neutrality. In addition, the inserts can be used in different lengths on different models in a range of products. Forming the insert of low density foam material is important to provide the ability to absorb unwanted sound frequencies, and enables the insert to be flexible. In particular sound is absorbed at the frequency of longitudinal acoustic resonances in the port, reducing output above the band-pass region. The foam is preferably closed cell rather than open or reticulated, so as to form an airtight seal with the outer supporting tube and so avoid the air leaks and resistive losses which are known to be highly detrimental to reflex enclosures and result in decreased bass and distortion.

In addition the inserts can be used with the reflex ports of existing reflex loudspeakers, provided the existing reflex port (equating to the "outer tube") and the inserts are of matching size and configuration. The circumference (in the plane transverse to the elongate direction) of the inner wall of the insert may be substantially symmetric at any point along the length of the insert. This makes for ease of use (in that a user does not have to worry about the orientation of the insert when it is inserted into the reflex port), ease of calculation of acoustic effect, and ease of manufacture. For essentially the same reasons, the inner wall of the tube may be substantially symmetric in the elongate direction. The insert (as tubes generally do) has two open ends, and the inner wall of the insert may be narrower at at least one point between the ends than it is towards the ends of the tube; such an arrangement means that the insert acts as a kind of "throttle", the calculations to determine the acoustic effect of which are reasonably easy to calculate. Similarly, one or both ends of the insert may be flared outwardly, so as to blend in smoothly with the inner wall of the outer tube and avoid turbulence.

Reflex ports are commonly substantially circular, square, elliptical, racetrack or rectangular shaped along their inner wall; the outer wall of the insert may be similarly shaped, and the inner wall of the insert may be any one of these shapes (though for ease of manufacture the shapes of the inner and outer walls of the tube will typically match, but this need not necessarily be the case). The outer wall of the insert may be the same size (radially from the elongate axis) as the inner surface of the outer tube, so as to fit snugly therein, or it may be slightly oversized so as to have a slight interference fit. This is advantageous, as it helps ensure that the insert in use remains in the correct longitudinal position within the outer tube, and does not become dislodged except when a user wishes to remove it. Also, the foam insert does not rattle or vibrate within the outer tube which could detract from the audible performance of the loudspeaker. Other ways of retaining the insert in the correct longitudinal position within the outer tube (apart from when a user wishes to remove it) will be apparent to the skilled person, such as by providing a releasable adhesive, or forming the outer wall of the insert with lugs, ribs or recesses which mate with matching formation on the inner wall of the outer tube. Where cost allows it is also possible to use the resilience of a flange on the foam insert to provide the retaining force for a bayonet style fixing. It is also possible to mount the port in the terminal panel or other convenient part of the loudspeaker.

The insert may be the same length as the outer tube, or it may be longer or shorter. The insert may be provided with a lip of greater size than the inner circumference of the outer tube at one end of the tube, so that it is easy for a user to place the insert inside the outer tube at the correct longitudinal position, and not insert it "too far"; also, such a lip makes it easier for a user to extract the insert when desired.

The insert may be formed of or comprise any acoustic absorptive material, such as foam, felt,; we have made inserts out of closed cell foamed polymer material, as this is flexible yet robust and relatively inexpensive and easy to manufacture. The inner surface of the insert may be slightly rough, so as to introduce a small amount of turbulence in the adjacent boundary layer of air.

The invention extends to a kit comprising a number of such inserts, each of different dimensions, configuration and/or material, so that a user can easily tailor the frequency response as required. Such a range of insert lengths may be used with a set of interchangeable outer tubes of different lengths so as to provide further scope for tuning the loudspeaker performance A loudspeaker comprising one or more such inserts is also within the ambit of this invention.

BRIEF DESCRIPTION OF THE DRAWINGS

The invention will now be described by way of example, and with reference to the accompanying drawings, in which.

DETAILED DESCRIPTION OF THE EMBODIMENTS

Figure 1:
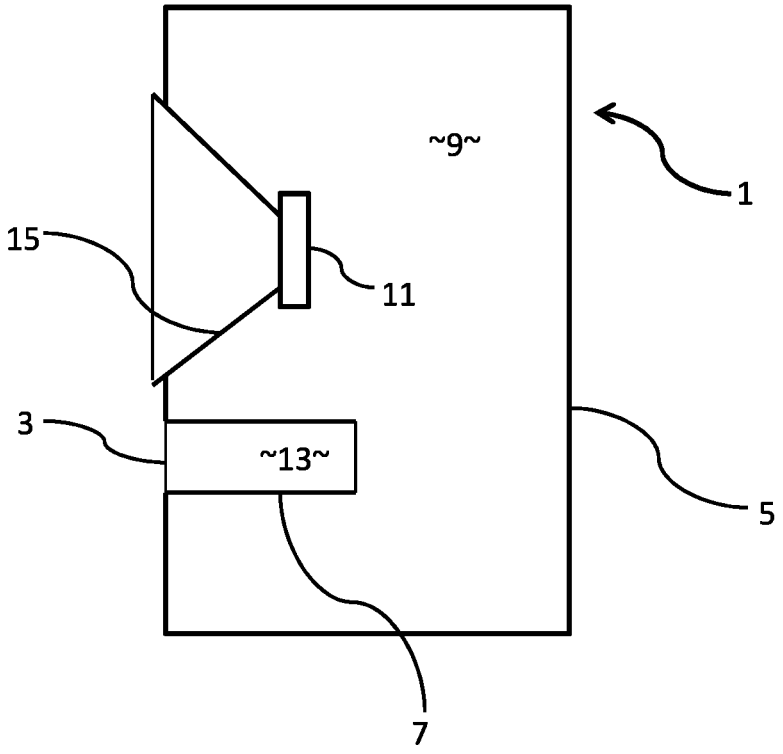
FIG. 1 Prior Art
FIG. 1 is a schematic view of a bass reflex loudspeaker with loudspeaker enclosure.
Figure 2:
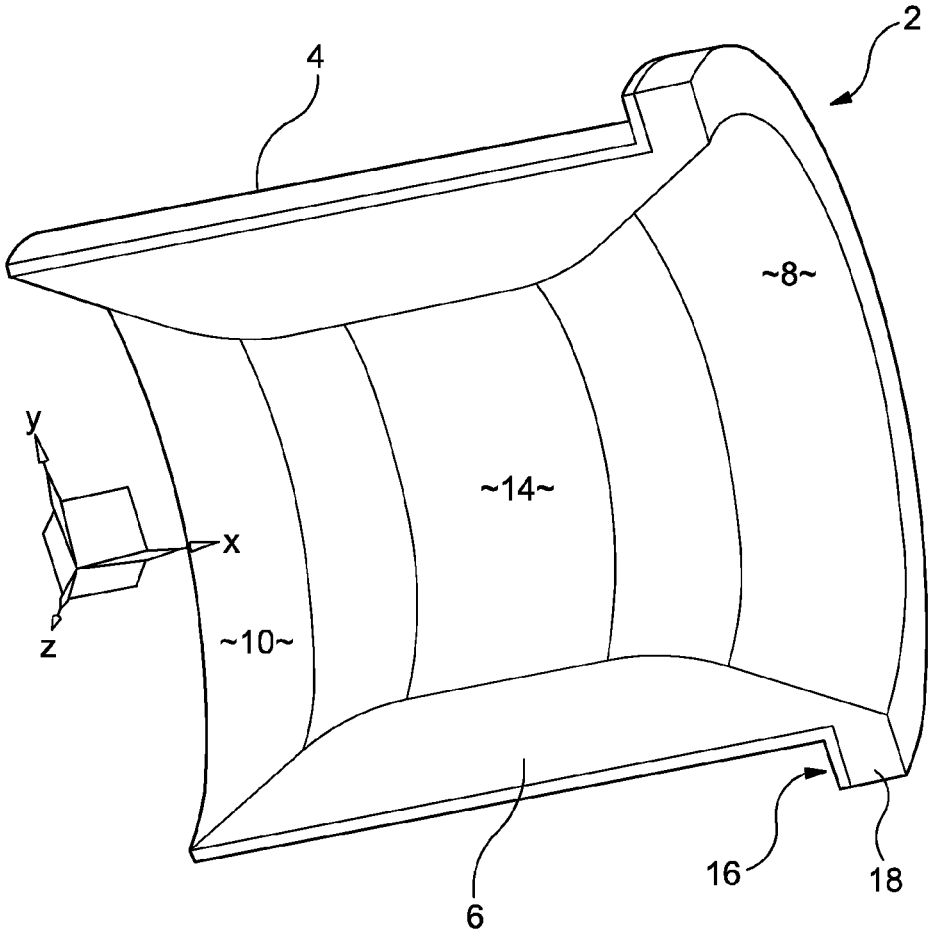
FIG. 2 is a schematic cut away view of an acoustic insert in accordance with the invention in position inside an outer tube forming a reflex port.

FIG. 2 is an isometric, cross-sectional schematic of an arrangement 2 comprising an acoustic insert 6 seated within an outer tube 4 which is fitted to the enclosure of a loudspeaker (not shown). The acoustic insert 6 and the outer tube 4 together form an open ended, cylindrical tube, with a first end 8 opening at the wall of the loudspeaker enclosure and a second end 10 inside the enclosure. The insert flares outwardly at the first and second ends, with a central portion 14 of smaller radius (around the X axis shown) than at the two ends. The first end of the outer tube 4 has a lip 16 which engages with the wall of the loudspeaker enclosure as is known in the art. The insert, which is made of low density foam material, is also formed with a matching lip 18, which seats on the lip 16 when the insert is fully inserted within the outer tube 4; this prevents the insert from being pushed too far inside the outer tube, and instead ensures that the insert 6 is in the correct longitudinal position (along the X axis) relative to the outer tube 4. Also, the lip 18, being outside the loudspeaker enclosure, is easy to grasp if the insert 6 is to be removed. In use, the insert tunes the resonance of the arrangement to attenuate certain frequency ranges (but not others), according to the configuration and dimensions of the inner wall of the insert 6), so as to alter the acoustic performance of the loudspeaker. The resilience of the material from which the insert is formed may be such that in use it deforms slightly and/or the inner wall of the insert deflects and so absorbs sound.

It will of course be understood that many variations may be made to the above-described embodiment without departing from the scope of the present invention. For example, there may be additional means to hold the insert 6 in place within the outer tube 4, as described above; a suitable place for the application of a releasable adhesive is at the interface between the lips 16, 18; if a peelable adhesive is applied to one or other lip, this holds the insert securely in place until, when the insert is to be removed, the insert lip 18 is peeled away from the port lip 16 and the insert can then be pulled out of the outer tube. Other means could be used to releasably connect the lips 16, 18, such as a bayonet fixing, and/or the lip 16 could be separate from the outer tube 4: this would be advantageous, as such a separate lip could then be configured for mounting the arrangement to a loudspeaker enclosure, with different configurations being available for use with different enclosures. Where the foam insert is self-supporting, part of it may protrude beyond the end of the outer tube. The insert 6 is shown with only a single constriction (generally at 14), however there could be two or more constrictions spaced along the X axis, and the longitudinal shape could be like a wave (e.g. sinusoidal). The inner surface of the tube 6 is shown as being longitudinally symmetric (i.e. along the X axis) and concentric, but there may be benefits in some applications for it to be asymmetric (e.g. the "peaks" and "troughs" in a wave-shaped inner surface may not be equally spaced). As stated above, the inner circumference of the insert is symmetrical at any point along the X axis, however it may be any shape, including asymmetric; in general however, the acoustic calculations are simplest for where the insert is cylindrical and/or symmetric/concentric. Those skilled in the art will understand that, for a generally cylindrical insert (as illustrated), the internal diameter may be varied, as well as its length, to give a wider range of tuning frequencies for less variation in depth, and that similar considerations apply to non-symmetric and/or non-concentric inserts. The inner surface of the insert 6, being made of foam, has a certain roughness, however this surface could in some configurations be coated so as to have a smooth surface; alternatively the insert 6 could be formed with a smooth inner surface. For example by moulding the insert in a foamed material the surface of the moulding forms a solid skin which is sufficiently smooth. The insert 6 could be coloured or bear suitable markings to indicate its effect on tuning the frequency response of the loudspeaker (for example, the inserts could vary in shade, with darker hues indicating a "lower" tune and lighter hues a "higher" tune, or they could be numbered according to a list of different degrees of tuning). The insert may advantageously also comprise means for damping longitudinal resonance such as the impermeable, frequency-dependent acoustic leakage path arrangements described in GB2488758 (which provides a frequency-dependent acoustic leakage path in the reflex port tube, such as by having a port conduit acoustically coupling the interior of the enclosure to a region external thereto, the port conduit comprising an acoustic leakage path through a motile part thereof in a direction transverse to a longitudinal axis of the port conduit, the acoustic leakage path having a relatively high acoustic impedance at a first frequency value, and a relatively low acoustic impedance at a second, lower, frequency value; this can be achieved with a plurality of holes in the port tube and an impermeable membrane lining the conduit). The arrangement could be provided with a front flare, or annular facing element which has the dual purpose of clamping the front flange or lip 18 of the insert 6 to the lip 16 and of improving the appearance of the arrangement 2 when assembled. Furthermore, where different variations or alternative arrangements are described above, it should be understood that embodiments of the invention may incorporate such variations and/or alternatives in any suitable combination.

The invention claimed is:

1. An acoustic insert for lining an outer tube fitted to a loudspeaker enclosure to form a loudspeaker reflex port, the insert comprising an elongate hollow tube formed of a flexible, low density foamed polymer material, and having an outer wall sized and configured to seat removably within the outer tube and an inner wall extending in the elongate direction, the inner wall having a circumference which varies along the length of the insert, the reflex port and the enclosure being so dimensioned that air inside the reflex port acts as an acoustic mass, air inside the enclosure behind the driver acts as an acoustic compliance and together the air inside the reflex port and the enclosure form a Helmholtz resonator in the audio bass range.

2. The acoustic insert according to claim I wherein at any point along the length of the insert, the circumference of the inner wall of the insert is substantially symmetric.

3. The acoustic insert according to claim 1 wherein the inner wall of the insert is substantially symmetric in the elongate direction.

4. The acoustic insert according to claim I wherein the insert has two open ends and the inner wall of the insert is narrower at at least one point between the ends than it is towards the ends of the insert.

5. The acoustic insert according to claim I wherein the insert has two open ends and the inner wall of the insert is flared outwardly at at least one of the ends.

6. The acoustic insert according to claim 1 wherein the inner and/or outer wall of the insert, when viewed along the elongate direction, is substantially circular, elliptical, square or racetrack shaped.

7. The acoustic insert according to claim 1 wherein the outer wall of the insert is substantially the same size as an inner surface of the outer tube.

8. The acoustic insert according to claim I wherein the outer wall of the insert is sized so as to be an interference fit inside the outer tube.

9. The acoustic insert according to claim I wherein the insert is the same length as the outer tube.

10. The acoustic insert according to claim I wherein the insert is provided with a lip of greater size than the inner circumference of the outer tube at one end of the insert.

11. The acoustic insert according to claim I wherein the insert comprises an acoustic absorptive material.

12. The acoustic insert according to claim I wherein the inner wall of the insert deflects so as to absorb sound.

13. The acoustic insert according to claim I wherein the length of the tube is substantially the same as the length of the outer tube.

14. The acoustic insert according to claim I wherein the length of the tube is not the same as the length of the outer tube.

15. A kit comprising a plurality of acoustic inserts according to claim 1, of differing dimensions, configuration and/or material.

16. A loudspeaker of the reflex port type comprising one or more acoustic inserts according to claim 1.

17. The acoustic insert according to claim I wherein the foam polymer material is formed with closed cells.

* * * * *